United States Patent [19]

Hirai et al.

[11] Patent Number: 4,490,596

[45] Date of Patent: Dec. 25, 1984

[54] INDUCTION COOKING APPARATUS HAVING COOLING ARRANGEMENT THEREFOR

[75] Inventors: Yukio Hirai, Takarazuka; Keizo Amagami, Takatsuki; Takao Kobayashi, Hirakata; Shinichi Matsumoto, Nishinomiya, all of Japan

[73] Assignee: Matsushita Electric Industrial Co., Ltd., Osaka, Japan

[21] Appl. No.: 405,954

[22] PCT Filed: Dec. 25, 1981

[86] PCT No.: PCT/JP81/00414

§ 371 Date: Aug. 5, 1982

§ 102(e) Date: Aug. 5, 1982

[87] PCT Pub. No.: WO82/02313

PCT Pub. Date: Jul. 8, 1982

[30] Foreign Application Priority Data

Dec. 26, 1980 [JP] Japan ..... 55-186367

[51] Int. Cl.[3] ..... H05B 6/12

[52] U.S. Cl. ..... 219/10.49 R; 219/10.75; 361/384; 126/21 A; 165/122; 165/59

[58] Field of Search ..... 219/10.49 R, 10.75, 219/400, 10.67; 165/122, 59; 126/21 A, 21 R; 361/383, 384, 424

[56] References Cited

U.S. PATENT DOCUMENTS

| | | | |
|---|---|---|---|
| 2,346,410 | 4/1944 | Ashley et al. | 165/122 X |
| 2,697,587 | 12/1954 | Conison | 165/122 X |
| 3,840,067 | 10/1974 | Bos | 165/122 X |
| 4,169,222 | 9/1979 | Tucker | 219/10.49 R |
| 4,191,875 | 3/1980 | Cunningham | 219/10.49 R |

FOREIGN PATENT DOCUMENTS

| | | | |
|---|---|---|---|
| 2340513 | 9/1977 | France | 219/10.49 R |
| 50-127744 | 10/1975 | Japan . | |
| 53-44172 | 4/1978 | Japan . | |
| 54-13036 | 1/1979 | Japan | 219/10.49 R |

OTHER PUBLICATIONS

Simons, "Solid-State Enhanced Cooling Package"; IBM Technical Disclosure Bulletin, vol. 22, No. 8A, Jan. 1980.

P. H. Peters, "IEEE Transactions on Industry Applications", vol. 1A-10, No. 6, Nov./Dec. 1974, pp. 814-822, FIG. 4.

*Primary Examiner*—P. H. Leung

*Attorney, Agent, or Firm*—Wenderoth, Lind & Ponack

[57] ABSTRACT

An induction cooking apparatus having a plurality of induction heating coils disposed in an array for induction-heating a metallic heating load by electromagnetic induction. Air inlet ports are formed at the front end of the appliance to admit cooling air for cooling the interior of the cooking appliance and air outlet ports are formed at the rear end of the appliance. The apparatus ensures comfortable cooking without exposing the user to hot exhaust air and, also, better cooling without drawing in hot exhaust air or hot steam from the food materials. Furthermore, a partition is provided within the appliance for separating the power converter unit from the operating unit for blocking objectionable movement of cooling air and blocking induction radiation from the power converter unit so as to protect the operating unit from the induction radiation from the power converter unit and prevent faulty operation thereof, and a cooling fan is disposed in an orifice in the partition for circulating cooling air within the appliance and ensuring an efficient cooling performance.

6 Claims, 11 Drawing Figures

INDUCTION COOKING APPARATUS HAVING COOLING ARRANGEMENT THEREFOR

TECHNICAL FIELD

This invention relates to an induction heating type cooking apparatus for heating an article by electromagnetic induction, and more particularly to a cooking apparatus including a partition adapted to ensure an effective cooling of the interior of the apparatus and shielding against induction radiation to thereby prevent noise-triggered erratic operations of the apparatus.

BACKGROUND ART

There are two types of induction heating applicances. The first type is that in which a conventional power supply is converted by an inverter including a transistor, a thyristor, etc. into a high frequency current of about 20 KHz, for instance, and the resulting high frequency current is fed into a plate-like induction heating coil for the purpose of heating a pan or the like. The second type is that in which a low frequency current is supplied to a plate-like induction heating coil without converting it into a high frequency current. When an electrically conductive cooking pan is mounted over the induction heating coil on a top plate of insulating material, a magnetic flux is developed across the conductive pan to induce an electromotive force in the conductive pan which produces an eddy current. The eddy current, combined with the resistance of the conductive pan, generates heat and heats the conductive pan itself and thus the food to be cooked in the pan. Since the magnetic flux developed from the induction heating coil serves to heat the pan directly, this method has much smaller heat loss and higher efficiency than the conventional methods using firewood, gas, kerosene or an electric heater and reduces energy consumption to a minimum and makes a remarkable contribution to energy savings.

A way to improve cooking efficiency is to provide a plurality of the induction heating coils in the above mentioned type of the induction heating appliances but faces great difficulties in cooling the whole of the appliance.

FIG. 11 depicts flows of cooking air in a conventional cooking appliance having a coil B and a power supply P but with no partition therein. Since a small-sized axial-flow fan F used in such induction heating type cooking appliances generally can produce only a very small static pressure, the smaller the effective areas of air inlet and outlet ports the greater the resistance of incoming air and outgoing air and the difference in static pressure between the air inlet region of the fan in the cabinet space and the air outlet region. As a result, a reverse-current air circulation path (or short circuit circulation path) is formed in the cabinet space to thereby drastically reduce the efficiency of cool air intake and hot air exhaust. More especially, as shown in FIG. 11, the internal pressure at the air inlet region 36 of a cabinet C is negative relative to the internal pressure at the air discharge region 37 of the cooling fan F and pressure external of the cabinet (namely, the atmospheric pressure). The amplitudes of the pressures in the respective regions are in the relation: pressure of the region 37>atmospheric pressure>pressure of the region 36. Therefore the difference in pressure between the regions 37 and 36 is a maximum. As a result, a substantial amount of air flows in a reverse direction and circulates as indicated by the arrows in FIG. 11.

The cooling fan loses several tens of percent of its full capacity for a reverse flow and circulation of the hot air and undergoes a significant decrease in the efficiency of drawing in outside cool air and discharging hot air, thus sending a flow of air of elevated temperature relative to the atmospheric air to the solid state power converter unit. This results in a greatly decreased efficiency of cooling off the circuit components and therefore results in a need for a cooling fan of a higher capacity and a heat sink.

DISCLOSURE OF THE INVENTION

Accordingly, it is an object of the present invention to provide a multiple burner induction heating type cooking apparatus which has many advantages over the prior art appliances, such as high efficiency, convenience for the user, ease of maintenance, simple and low cost structure, etc. which are achieved by simple, economical and reasonable structural changes.

According to the present invention, a cooking apparatus is provided which is designed to be very convenient to use from a standpoint of human engineering by arranging a plurality of heating units horizontally in a line and providing an operation unit, a display unit or a cutting board in front of the heating units. Furthermore, the efficiency of the cooling components is enhanced drastically by completely separating a plurality of solid state power converter units including heating coils from a low frequency power supply unit (a power switch, a noise filter, power terminals, etc.), structural assemblies such as an input power regulator unit, an input display unit and so forth by the use of a partition and providing a forced air cooling unit in a special location in the apparatus. The use of the partition ensures enhancement of the mechanical rigidity of a cabinet and minimization of noise (Radio Frequency Interference). In addition, a separable top plate provides a high degree of serviceability. Consequently, there is provided a cooking apparatus which is excellent from the standpoint of cost, performance and other diverse aspects.

BEST MODE FOR CARRYING OUT THE INVENTION

Figure 1:
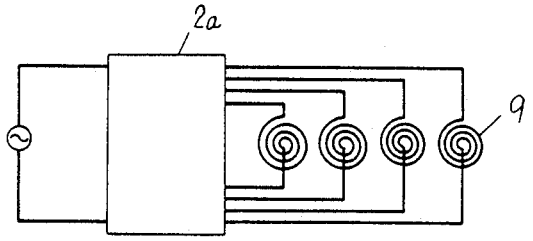
FIG. 1 is a schematic view of an induction heating type cooking appliance according to an embodiment of the present invention.
Figure 2:
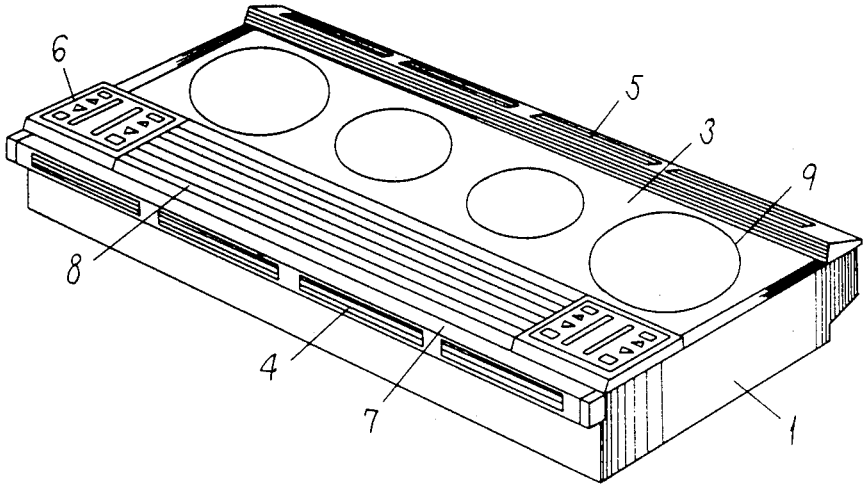
FIG. 2 is a perspective view of the whole of the induction heating type cooking appliance.

FIG. 1 shows an induction heating type appliance according to the present invention, wherein a plurality of heating coils 9 are provided in a plurality of solid state power converter circuits 2*a*, respectively. Referring to FIG. 2, the cabinet is made up of a casing 1 surrounding the bottom and periphery of the cabinet, a pan supporting panel 3 disposed over the heating coils, control panels 6 carrying operation units and display units, and a front top plate 7 supporting the control panels and hinged to the panel 3 for the forming part of the top. A cutting board 8 or the like is mounted on the front top plate 7. The plurality of the heating coils housed in the cabinet are aligned in a rectilinear fashion in a horizontal line as viewed from the front, and the respective ones of the display units corresponding to the heating coils are similarly aligned horizontally in a rectilinear fashion.

The cabinet is provided with air inlet ports 4 in the front or lower front portion and air outlet ports 5 at the back upper portion for admitting air for air-cooling the solid state power converter circuits.

Figure 3:
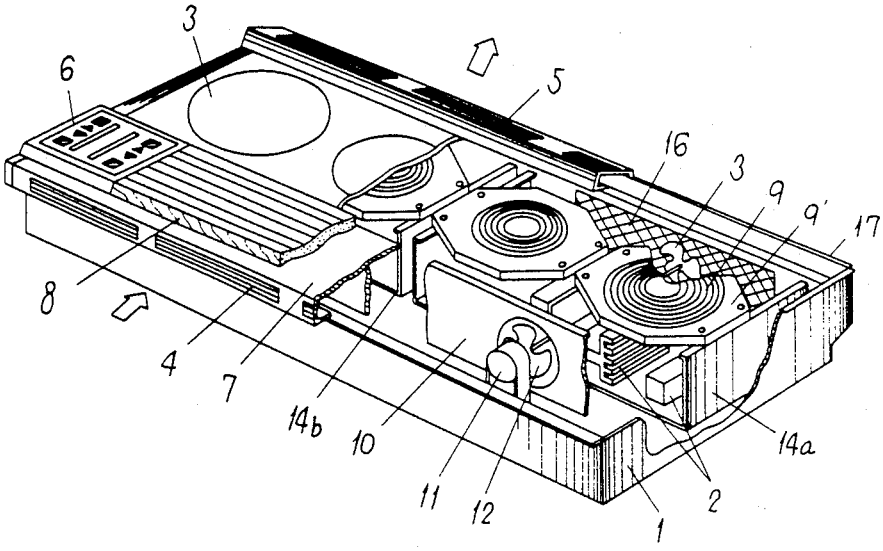
FIG. 3 is a perspective view, partly broken away of the induction heating type cooking appliance.
Figure 4:
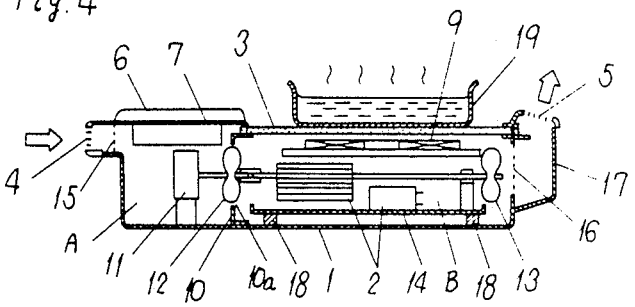
FIG. 4 is a cross sectional view of the induction heating type cooking appliance.

As seen in FIGS. 3 and 4, the interior of the cabinet is divided into front and back portions by a metallic partition 10 and a forced air cooling unit (a motor 11 and a cooling fan 12) is disposed in an orifice 10*a* in the partition 10. Air is drawn through the air inlet ports 4 in the front of the cabinet and discharged through the air outlet ports 5 in the upper back portion of the cabinet by the operation of the cooling fan 12. The chamber defined by the partition 10, the casing 1 and the pan supporting panel 3 is referred to as chamber B and the chamber defined by the partition 10, the casing 1 and the front top plate 7 is referred to as chamber A, and power circuit components 2 forming the solid state power converter circuits including the heating coils 9 are disposed in chamber B behind the partition 10 and the control panels 6 including the power switches, the input regulator units and the input level display units are disposed in chamber A in front of the partition 10. The cooling fan 12 is driven by the motor 11.

In addition, the power circuit components 2 forming the solid state power converter circuits including the heating coils 9 are mounted on a plurality of internal chassis 14 electrically isolated from the cabinet by insulating spacers 18, which chassis 14 are mounted within the chamber behind the partition 10 in the cabinet, that is, chamber B. In the illustrated embodiment, two chassises 14*a* and 14*b* each having two heating coils are housed in the cabinet. Two cooling fans 12 are provided, one for each of the corresponding one of the chassis. A discharging fan 13 is further provided in the neighborhood of the air outlet ports 5 and driven by the motor 11 to rotate with the cooling fan 12 feeding input air. In the embodiment shown in FIGS. 3 and 4, the two fans are axial-flow fans driven by the same motor.

Barriers 15 and 16 of an expanded metal plate or louvers are disposed in the neighborhood of the air inlet and outlet ports as a means for preventing foreign substances from entering. A drain duct is 17 is provided under outlet port and a cooking pan 19 is shown resting on panel 3.

Figure 5:
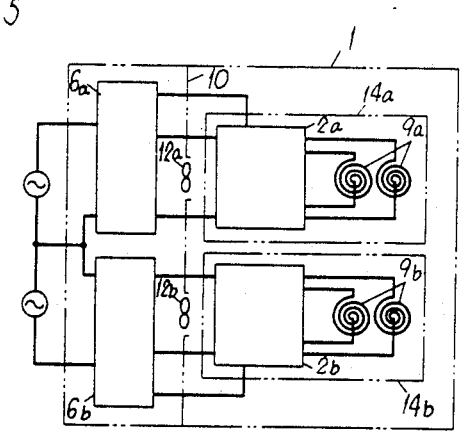
FIG. 5 is a schematic circuit diagram of the cooking appliance.

FIG. 5 is a block circuit diagram of the embodiment shown in FIGS. 3 and 4, wherein the cabinet and the chassis are shown in dot-broken lines. Within the cabinet 1 there are housed a plurality (two) of solid state power converter circuits 2*a* and 2*b* each including the plurality (two) of the heating coils 9*a* and 9*b* and the operation and display units comprising the input regulator circuits and the input level display circuits 6*a* and 6*b*, the former and latter being physically separated by the partition 10. The solid state power converter circuits 2*a* and 2*b* are positioned respectively on the internal chassis 14*a* and 14*b*.

Figure 6:
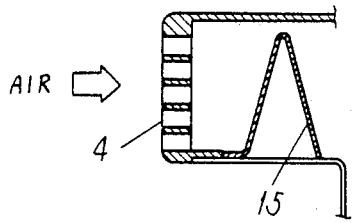
FIG. 6 is a cross sectional view of an air inlet portion of the cooking appliance.
Figure 7:
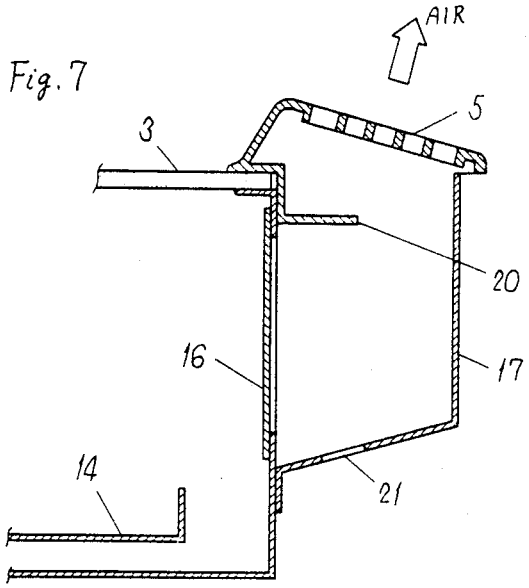
FIG. 7 is a cross sectional view of an air outlet portion of the cooking appliance.

FIG. 6 shows in cross section the air inlet ports 4 and FIG. 7 shows in cross section the air outlet ports 5. In FIG. 6, the barrier 15 constituted by a double plate structure made of an expand metal plate or louvers is oriented inside the air inlet ports 4 in such a direction as to block foreign substances or splashes of water from entering.

In FIG. 7, a hood-like baffle plate 20 of desired width and length is disposed inside the air outlet ports 5 under the parts 5 and the barrier 16 of expanded metal plate or louvers is disposed under the hood-like baffle plate 20 for preventing water drops or foreign substances from entering through the upper air outlet ports 5 into the internal chassis 14. A plurality of openings 21 is provided in the bottom of the drain duct 17 to drain away water which may collect. The combination of the baffle 20, the barrier 16 and the drain perforations 21 eliminates completely the possibility that water will flood into the cabinet through the air outlet ports 5.

Figure 8:
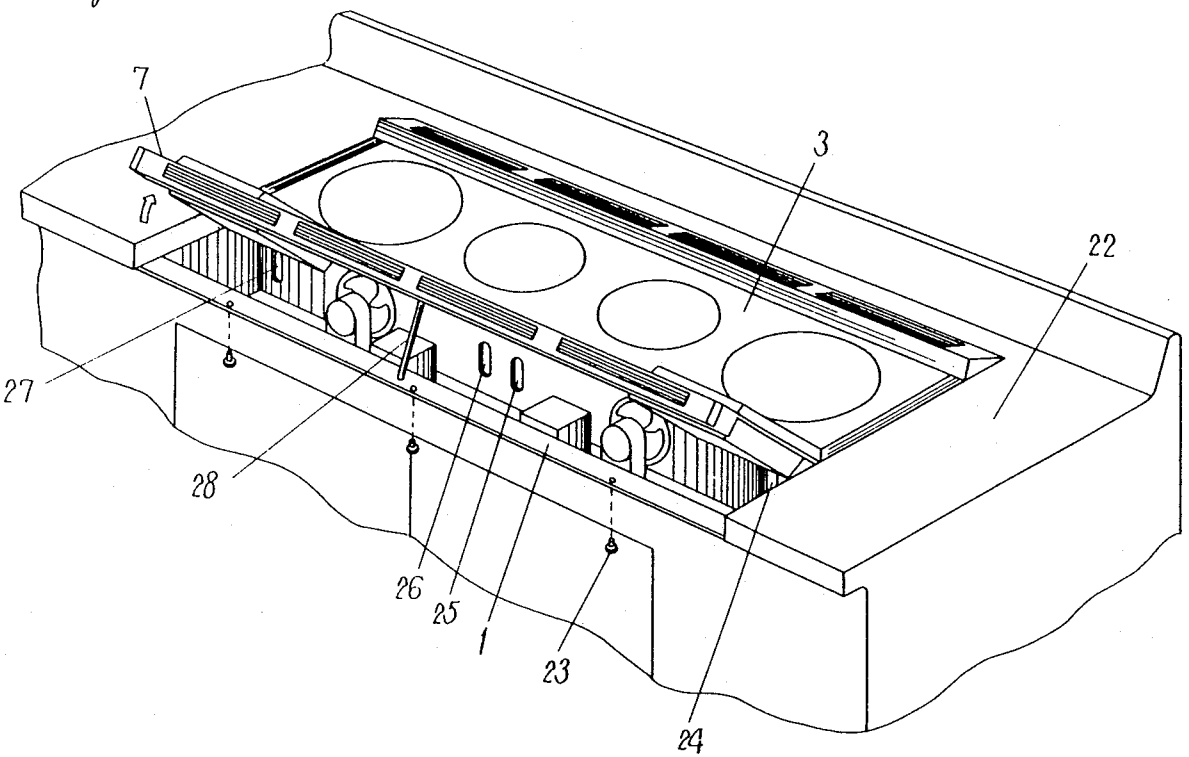
FIG. 8 is a perspective view of the cooking appliance installed in a counter.

FIG. 8 shows the induction heating type cooling appliance built into a counter top 22 in a way for enhancing serviceability. The pan supporting panel 3 and the front top plate 7 can be raised and the front top plate 7 can be installed and removed together with the pan supporting panel 3 fixedly secured thereon. The casing 1 and the front top plate 7 are fixed to the bottom side of an extension of the countertop 22 by means of fixing elements 23. To exchange the components within the casing, these elements 23 are first removed and the pan supporting panel is then detached. Upon completion of the exchange of components, the pan supporting panel 3 is first fixed and a cooking pan is then placed on the pan supporting panel 3 while the front top plate 7 is pivoted to an open position. An adjusting pin is inserted via input adjustment openings 24, 25, 26 and 27 to rotate adjusting volume controls provided in the classis for input adjustment. This procedure is also performed in the final step of assembly.

A support rod 28 is provided to support the front top plate 7 in the open position. With such an arrangement, since the induction heating type cooking appliance of the built-in type is fully serviceable from above, there is no requirement for removing the cabinet whenever the appliance is to be repaired, thus assuring a higher degree of serviceability.

The induction heating type cooking appliance embodying the present invention will be further described with respect to its operation and advantages.

The effects of arranging the heating coils 9 horizontally in a line as shown in FIGS. 1 and 2 are; (1) the appliance provides safety and convenience for the user, and (2) the layout of the respective units housed in the internal space of the housing is simple and the cooling arrangement for the units is also simple in structure. This ensures an enhanced serviceability.

Since in FIGS. 3 to 5 the input control units in chamber A generally include electronic components susceptible to damage by being subjected to a high temperature, such as semiconductor devices and capacitors, it is necessary constantly to keep the temperature of the surrounding atmosphere below a given value. The input control units of the above described cooking appliance, however, are never exposed to hot air but rather are constantly being cooled with flowing cool atmosphere air.

The power circuit components 2, such as power semiconductor devices which constitute the solid state power converter circuits and produce a substantial amount of heat and the heating coils are disposed on the air discharge side of the cooling fan 12 in the chamber B and they release heat to the flow of cold air flowing at a rate of several meters per second. Of course, the high temperature circuit components such as choke coils are also disposed on the air outlet side in order to ensure highly efficient forced air cooling.

Figure 9:
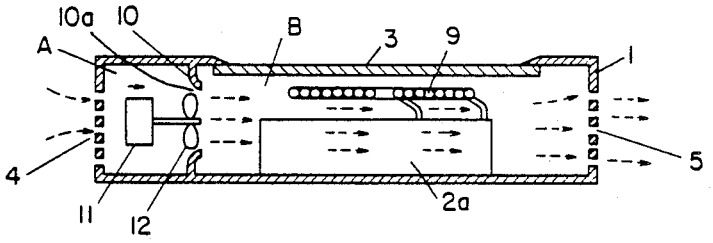
FIG. 9 is a vertical cross sectional view of the cooking appliance.
Figure 10:
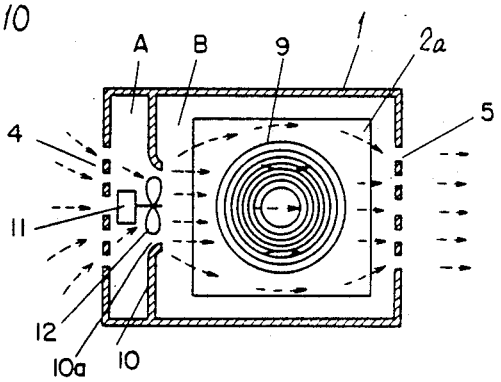
FIG. 10 is a horizontal cross sectional plan view of the cooking appliance.

As shown schematically in FIGS. 9 and 10, air inlet port 4 and air outlet port 5 are formed in the casing 1, and the cooling fan 12 and the cooling fan motor 11 are provided in the vicinity of the air inlet port 4, and the solid state power converter circuit 2*a* is on the air discharge side of the fan. The partition 10 has the orifice 10*a* in which the cooling fan 12 is positioned and the internal space of the cabinet 1 is divided into the chamber A which is a fan-loaded air suction chamber and the chamber B for housing the solid state power converter unit. The arrows (dotted lines) in these drawings indicate flows of cooling air.

Figure 11:
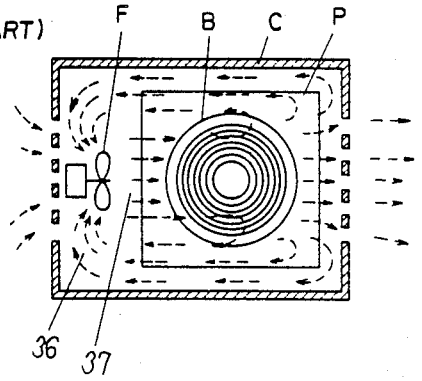
Fig. 11 (PRIOR ART)
FIG. 11 is a horizontal cross sectional plan view of a conventional induction heating type cooking appliance.

As seen from FIGS. 9 and 10, the function of the partition with the orifice in which the cooling fan is disposed is to partition the interior of the cabinet into the housing chamber B and the fan-loaded air suction chamber A with the maximum difference in internal pressure therebetween. This avoids the buildup of a reverse-current air circulation path (short circuit) caused by the differential in the internal pressure in the prior art structure of FIG. 11 so that air flow can follow the flow pattern as indicated by the arrows in FIG. 10 and hot air after cooling circuit components is discharged smoothly from the appliance due to the internal pressure in the cabinet. In other words, the provision of the apertured partition reduces to almost zero the energy loss of the fan caused by a reverse flow and circulation as in the prior art structure and takes advantage of the full capacity of the fan in drawing cooling air from outside and discharging hot air, thus assuring a significant increase of cooling efficiency. Furthermore, air outlet ports of an orifice configuration on the periphery of fan blades eliminates the loss occurring when the fan blades stir and cause friction with the ambient static air and rectifies the flows of input air and exhaust air. This rectifying effect guarantees a further improvement in the air blowing efficiency of the fan as well as reducing turbulence noise. Since the apertured partition provided in the cabinet serves two functions, i.e. inhibiting a reverse flow and circulation of hot air and rectifying the air flow as stated previously, the cooling efficiency is remarkably increased so that even with a small sized axial-flow fan, a cooling performance comparable to that of a conventional cross-flow fan or a battery of axial-flow fans can be obtained.

The above cooling scheme offers many advantages, some of which are as follows:

1. An improvement in cooling efficiency by elimination of a reverse current and circulation (short circuit) of hot air in the cabinet space.

2. An improvement in cooling efficiency thanks to the rectifying effect.

3. Reduction of turbulence noise due to the rectifying effect.

4. Compactness of the whole appliance because of improved cooling efficiency which permits use of small-sized circuit components such as a heat sink and a small-sized fan for the cooling means.

5. Ability to use a low cost and small-sized axial-flow fan rather than an expensive cross-flow without increasing the height of the cabinet.

Features and advantages of two serially-connected cooling fans will be discussed with reference to FIG. 4.

As set forth above, the small-sized axial-flow fan can produce only a low static pressure and has poor air blowing efficiency due to the air suction and exhaustion resistance. In other words, if a single axial-flow type fan 12 is used as a blower fan, then it will be impossible to produce a static pressure high enough to overcome the air exhaustion resistance so that objectionable scattering and circulation of air will take place in the cabinet. This entails a loss of efficiency and requires the use of a larger fan. However, when another axial-flow fan 13 is added at the air exhaust outlet as shown in FIG. 4, it is possible to increase the static pressure at the air outlet and to more readily overcome the air exhaust resistance. This leads to an increased efficiency of hot air removal and an increased blowing efficiency of the fan 12 on the air inlet side. Accordingly, when the two serially-connected small-sized axial-flow fans 12 and 13 are driven with a single motor 11, a further improvement in the efficiency of cooling of the components and in the compactness of the cabinet is obtained.

The effects that are obtained when air is drawn from the front of the appliance and discharged upwardly from the rear of the appliance are: (1) the user is not exposed to hot air; (2) the high temperature steam and air generated from the cooking pan 19 are prevented from being introduced via the air inlet ports 4, so that the circuit components in the cabinet are protected from the steam and hot air. This is achieved by placing the heating unit well behind the air inlet ports, mounting the operation unit, display unit, cutting board, etc. on an upper front surface in the vicinity of the air inlet ports, thus placing the air inlet ports 4 are relatively remote from the cooking pan 19; and (3) because the outlet ports are formed in the top, exhaust heat in air with a relatively low specific gravity is dissipated upwardly as an ascending current and leaves the appliance, thus adding a synergistic effect to the forced air cooling.

The following are the effects on R.F.I. and noise-triggered troubles when the solid state power converter unit, operation unit and display unit are accommodated independently of each other in the cabinet, and separated by the partition 10. It is well known that the solid state power converter unit handling a high frequency high level power supply will develop an undesirable interference (R.F.I.) of substantially high level. Therefore, in the event that a low frequency power unit is disposed in the high frequency high level power converter unit, electric wiring in the low frequency power unit is exposed to induction radiation which in turn raises the level of noise at the terminals of the appliance. In addition, if the high level power handling unit is located near the low power unit, the undesirable radiation will cause a noise-triggered failure. According to the present invention, the influence of induction on the power unit and control unit is minimized by providing the high frequency high level power unit and the power unit independently of the input control unit, i.e. electronic control unit. Moreover, the operation of the appliance is reliable and free form noise-triggered failure and with a minimum of noise terminal voltage (R.F.I. Conduction) due to the provision of the partition 10 serving as an induction shield therebetween.

Since the periphery of the heating coils 9 with the maximum amount of undesirable radiation (R.F.I. radiation) is surrounded by the metallic casing 1 and metallic partition 10 forming a metallic framework or an electric closed loop, as is clear from FIG. 3, this framework serves as a kind of induction shield for the radiation (R.F.I. radiation) generated from the heating coils 9 and decreases the total amount of radiation (R.F.I. radiation) escaping from the appliance.

The effects of the partition 10 will be further discussed from a standpoint of mechanical rigidity. It is evident from FIGS. 3 and 4 that the cabinet composed of three components, the casing 1, the pan supporting panel 3 and the top plate 7 is unsatisfactory as a whole in rigidity and particularly the top comprising the two components is mechanically weak in rigidity.

The flat-bottomed casing 1 is also weak. Therefore, when a heavy article is placed on the cooking appliance, the cabinet becomes greatly deformed with an accompanying variation in the spacing between the heating coils 9 and the panel 3 and such risky situations as destruction or damage to the panel 3, deflection of the shaft of the cooling fan, etc. However, the provision of the partition 10 as shown in FIGS. 3 and 4 makes the pan supporting panel 3 strong and enhances the rigidity of the bottom of the casing 1 and thus the rigidity of the whole structure. There is no need to use a thicker material or bead-forming material for enhancement of ridigity, resulting in a higher degree of cost effectiveness.

The following advantages are obtained, as can be understood from FIGS. 3 to 5, when the solid state power converter unit including the one or two heating coils is housed in internal chassis electrically isolated from the outside cabinet.

1. Each of the internal chassis having a module design housing the one or two heating coils therein is very helpful for troubleshooting or maintenance (serviceability). In other words, even if one of the modules fails to operate, one or more remaining modules are still operable. The module type chassis provide for simplicity of structure.

2. It is easy to seal off undesirable radiation (R.F.I.) from the power circuit in the internal chassis for each of the solid state power converter units. However, if a plurality of the solid state power converter units are housed in a common internal chassis, it is very difficult to seal off R.F.I.

3. It becomes possible to prevent interference between the heating coils when a separate internal chassis is provided for each of the heating coils. In the event that a shield is not present between the heating coils, interference will occur and be one of the causes of noise or abnormal operation due to the coil-to-coil difference in the waveform and frequency of high frequency fields. The greater the number of the heating coils within the single chassis, the higher the frequency of the above-mentioned troubles. The chassis having the module structure eliminate such drawbacks.

4. Forced air cooling is highly efficient because the side walls of the respective chassis serve as a duct.

5. The module structure is most suitable for mass production.

A cooling scheme where a forced air cooling means is provided for each of the internal chassis is advantageous, as follows:

1. Even if one of a plurality of the cooling fans is out of order, only the corresponding one of the modules is inoperable, with all the remaining modules being still operable. This feature facilitates maintenance and ensures a greatly reduced overall possibility of troubles as compared with the case in which the whole structure is cooled by a single fan.

2. When the respective fans are operatively associated with a corresponding solid state power converter circuit, the fan works only for the power converter circuit when it is in operation, eliminating unnecessary cooling and ensuring power savings as a whole.

The following advantages are further obtained when the plurality of internal chassis are disposed symmetrically and the directions of rotation of the plurality (two) of axial-flow fans in the internal chassis are also oriented symmetrically.

A major advantage is that the temperature dependency (temperature-responsive properties such as thermal efficiency, temperature gains of components, and anti-overheating feature in unloaded heating) of the power converter circuit (including the heating coils) in the left chassis is equal to that of the right chassis. If, however, either the chassis or the axial-flow fans are not symmetric, the left and right modules (the power converter circuits) have different temperature dependency and the heating performance will vary according to different burners. This is believed to be true from consideration of the fact that the distribution of air differs in all directions on the air inlet side, based upon the direction of rotation of the axial-flow fans.

In addition, it is very convenient to use if the operation unit and the display unit are disposed on both side edges of the top plate and the cutting board is disposed at the central portion of the top plate. Since the operation unit and the display unit are disposed at the two side edges, the operation and display units are not in the way of the users during cooking and the positioning of the cutting board at the center of the top plate contributes to a more effective utilization of space.

INDUSTRIAL APPLICABILITY

As described hereinbefore, the induction heating type cooking appliance according to the present invention ensures an efficient cooling of the interior of the appliance, a greater compactness of the whole structure and an increased ease of use.

We claim:

1. An induction heating type cooking apparatus comprising:

a casing defining a compartment therewithin;

a single pan supporting panel of non-magnetic high mechanical strength on said casing and defining at least a part of the top of said compartment;

a partition plate extending along and under said pan supporting panel and supporting said panel and dividing said compartment into a front portion and a rear portion and blocking counterflow of cooling air from said rear portion to said front portion, said partition having an opening therein between said portions;

a plurality of induction heating coils in said rear portion spaced from the under side of said panel;

solid state power conversion means for each heating coil and positioned in said rear portion and connected to the corresponding heat coil;

operating circuit means for each of the respective coils and including power switch means, power adjusting means for adjusting the power to the corresponding coil and display means for displaying the power input level, said operating circuit means being positioned in said front portion and electrically connected to the corresponding coils and having the operating controls for the switch means and the adjusting means and the display means exposed on the top of said casing;

said casing having an air inlet opening in said front portion and an outlet in the rear poriton open upwardly out of said casing at the upper part of the rear portion of said compartment;

a forced air cooling means mounted in said opening in said partition for drawing cooling air into said front portion through said air inlet, forcing the cooling air through said opening and through said rear portion and discharging it out through said air outlet.

2. An apparatus as claimed in claim 1 further comprising a plurality of inner chassis in the bottom of said compartment having electrically insulating spacers thereon insulating said chassis from the casing, each chassis having from one to two power conversion means and one to two heating coils thereon.

3. An apparatus as claimed in claim 2 in which said heating coils in said casing are aligned along said casing parallel to said partition.

4. An apparatus as claimed in claim 2 wherein said forced air cooling means comprises a forced air cooler device for each of said chassis.

5. An apparatus as claimed in claim 4 in which said forced air cooler devices are axial flow fans positioned in parallel in the corresponding openings in said partition, said fans rotating in the same direction.

6. An apparatus as claimed in claim 2 in which said chassis are positioned symmetrically within said casing.

* * * * *